United States Patent [19]

Bowman

[11] 4,412,796

[45] Nov. 1, 1983

[54] HELICAL SCREW ROTOR PROFILES

[75] Inventor: James L. Bowman, Davidson, N.C.

[73] Assignee: Ingersoll-Rand Company, Woodcliff Lake, N.J.

[21] Appl. No.: 296,035

[22] Filed: Aug. 25, 1981

[51] Int. Cl.[3] ..... F01C 1/20; F01C 1/16; F04C 18/20

[52] U.S. Cl. ..... 418/201

[58] Field of Search ..... 418/150, 201

[56] References Cited

U.S. PATENT DOCUMENTS

| | | | |
|---|---|---|---|
| 3,622,256 | 11/1971 | Drezdenskaya | 418/201 |
| 4,140,445 | 2/1979 | Schibbye | 418/201 |
| 4,350,480 | 9/1982 | Bammert | 418/201 |

FOREIGN PATENT DOCUMENTS

| | | | |
|---|---|---|---|
| 425689 | 2/1926 | Fed. Rep. of Germany | 418/206 |
| 2018897 | 10/1979 | United Kingdom | 418/206 |

*Primary Examiner*—Leonard E. Smith
*Assistant Examiner*—Jane Obee
*Attorney, Agent, or Firm*—B. J. Murphy

[57] ABSTRACT

The invention concerns helical- or screw-type driving and driven rotors having lands and intervening grooves for coacting engagement, within a housing of a machine, such as a gas compressor or expander, the rotors having improved, more efficient, profiles. The profiles are defined with contiguous elliptic and involute sections to improve the pressure angle, and the profiles are configured to define rotor-to-rotor sealing surfaces in closure of a compressed gas pocket in which, the pocket gas pressure always urges or torques the driven rotor in the positive or forward-rotary direction.

15 Claims, 5 Drawing Figures

HELICAL SCREW ROTOR PROFILES

This invention pertains to rotors of the helical or screw type having lands and intervening grooves which coact and mesh within a housing of a machine, such as a machine for compressing or expanding gas and, in particular, to such rotors having improved, more efficient, profiles.

The prior art is replete with rotor profiles, for machines of the type noted herein, which brought forth improvements in the performance of the machine. Exemplary thereof are U.S. Pat. Nos. 3,423,017 and 4,028,026, issued to L. B. Schibbye, on Jan. 21, 1969, for a "Screw Rotor Machine and Rotors Therefor", and to E. Menssen, on June 7, 1977, for a "Screw Compressor with Involute Profiled Teeth", respectively.

It is an object of this invention to set forth even more efficient rotor profiles which enhance machine performance by improving the pressure angle obtaining between the rotors, and also by defining sealing surfaces between driven and driving rotors which load or torque the driven rotor, by means of gas pressure in a sealed pocket, in the positive or forward-rotary direction.

It is particularly an object of this invention to set forth a rotor, having helical lands and intervening grooves, rotatable about an axis for coacting engagement, within a machine housing, with a cooperating, meshing rotor, in order that fluid admitted into such housing will be received in said grooves and, due to coacting mesh and rotation of said rotors, will have the pressure thereof altered, wherein said flanks of said grooves of said rotors are generally concave; each of said grooves has a leading flank and a trailing flank, relative to a given rotary direction of said rotor; and a first portion of said leading flank is a section of an ellipse.

Further objects and features of this invention will become more apparent by reference to the following description taken in conjunction with the accompanying figures in which.

Figure 1:
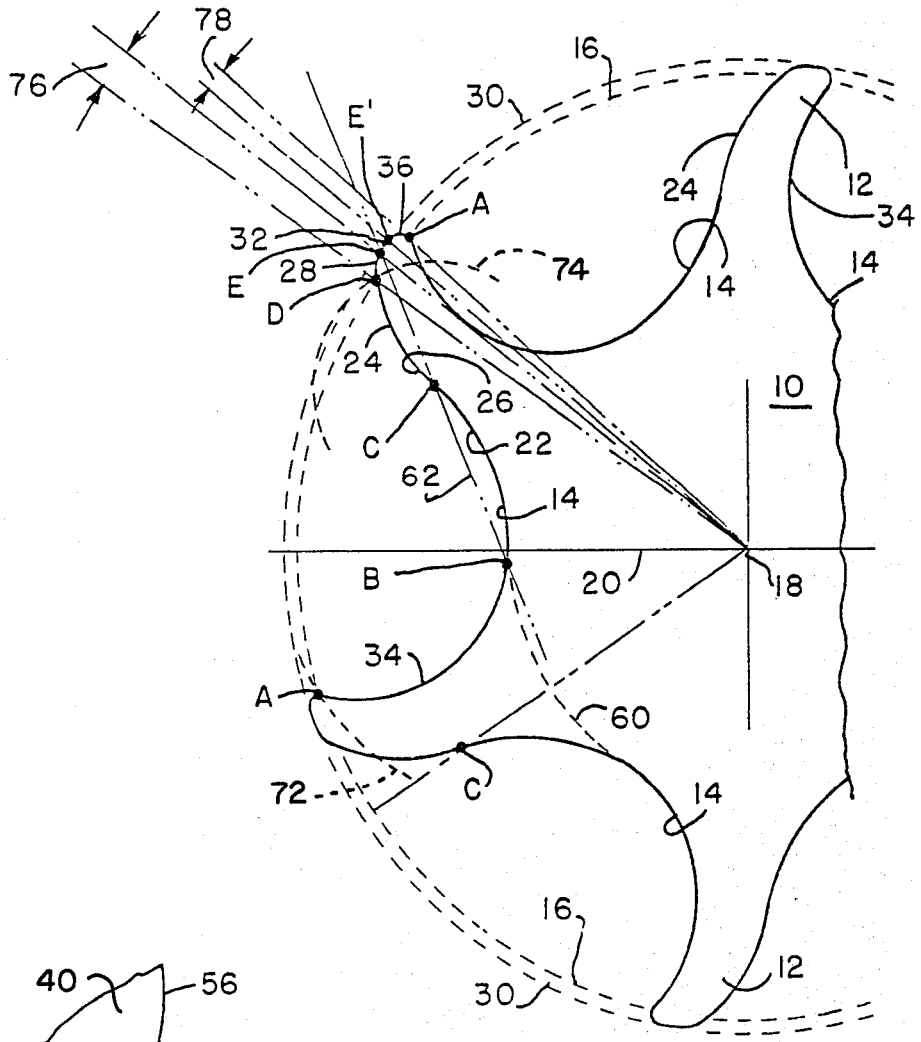
FIG. 1 is a line drawing of a profile of a portion of a driven, female rotor defined according to the invention.

As shown in FIG. 1, the driven, female rotor 10, according to an embodiment of the invention, has six helical ribs 12 (only two thereof being fully shown) and a like member of intervening, helical grooves 14 (not all fully shown). Relative to its coacting, male rotor (FIG. 2) female rotor 10 has a pitch circle 16 and a rotary axis 18. Axis 18 occupies a common plane 20 with the rotary axis of the male rotor, upon the two rotors being disposed in coacting, meshing engagement in a machine housing 21.

Figure 2:
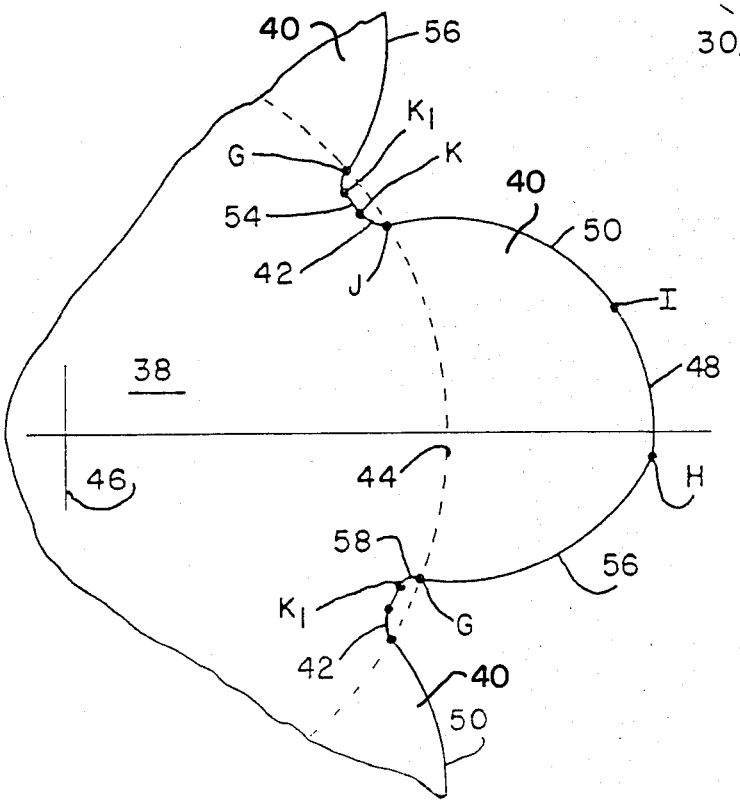
FIG. 2 is a partial line drawing of a profile of a portion of a coacting, driving, male rotor defined according to the invention.

According to the invention, the profile of the female rotor 10 is defined as follows. Section B-C of the female rotor 10 is a circular arc 22 with its center on the pitch circle 16. The circular arc 22 starts below the plane 20 and extends a little more than halfway up the driven, leading flank 24 of the rotor. Section C-D of the female rotor 10 is an involute section 26 tangent to the circular arc 22 at C. The involute section 26 terminates where it intersects the female rotor pitch circle 16. Section D-E of the female rotor 10 is an elliptical section 28 selected to be tangent to the involute section 26 at point D, and tangent to the outer diameter circule 30 at E. Section E-$E_1$ of the female rotor is a portion of a circular arc 32. Section B-A of the female rotor is an epitrochoid 34 generated by a point H on the male rotor (FIG. 2). Point A lies on the female rotor pitch circle 16. Section A-$E_1$ of the female rotor is a circular arc 36 with its center on the female rotor pitch circle 16, tangent to section 32, and passing thru point A.

With reference to FIG. 2, the driving, male rotor 38, according to an embodiment of the invention, has five helical lobes 40 (only one being fully shown) and a like number of intervening, helical grooves 42 (only two being shown). Relative to its coacting, female rotor 10 (FIG. 1), it has a pitch circle 44 and a rotary axis 46. As noted, axes 18 and 46, with the rotors 10 and 38 in coacting, meshing engagement, occupy the common plane 20.

Figure 3:
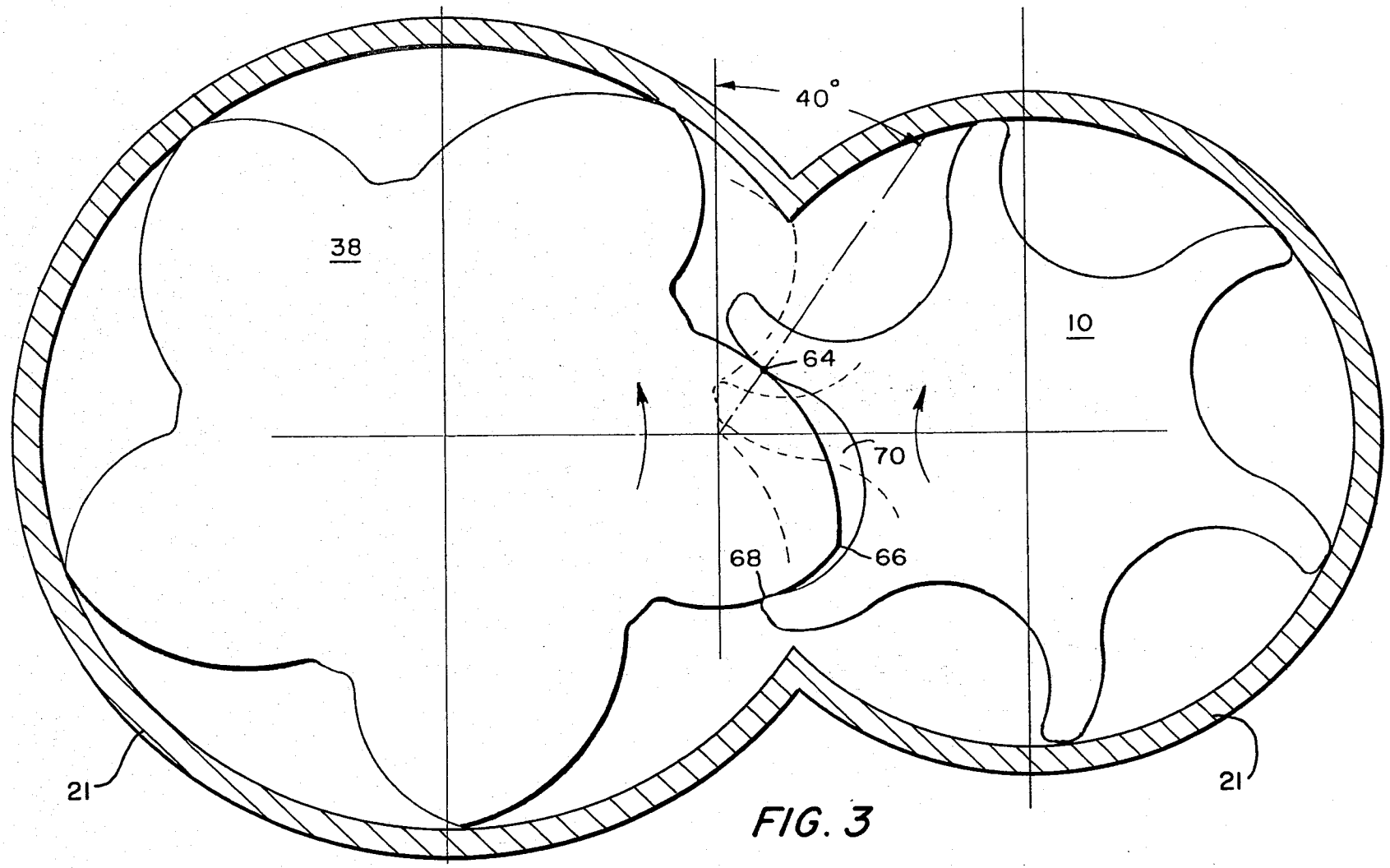
FIG. 3 is a line illustration of the full profiles of the rotors of FIGS. 1 and 2 in coacting engagement.
Figure 5:
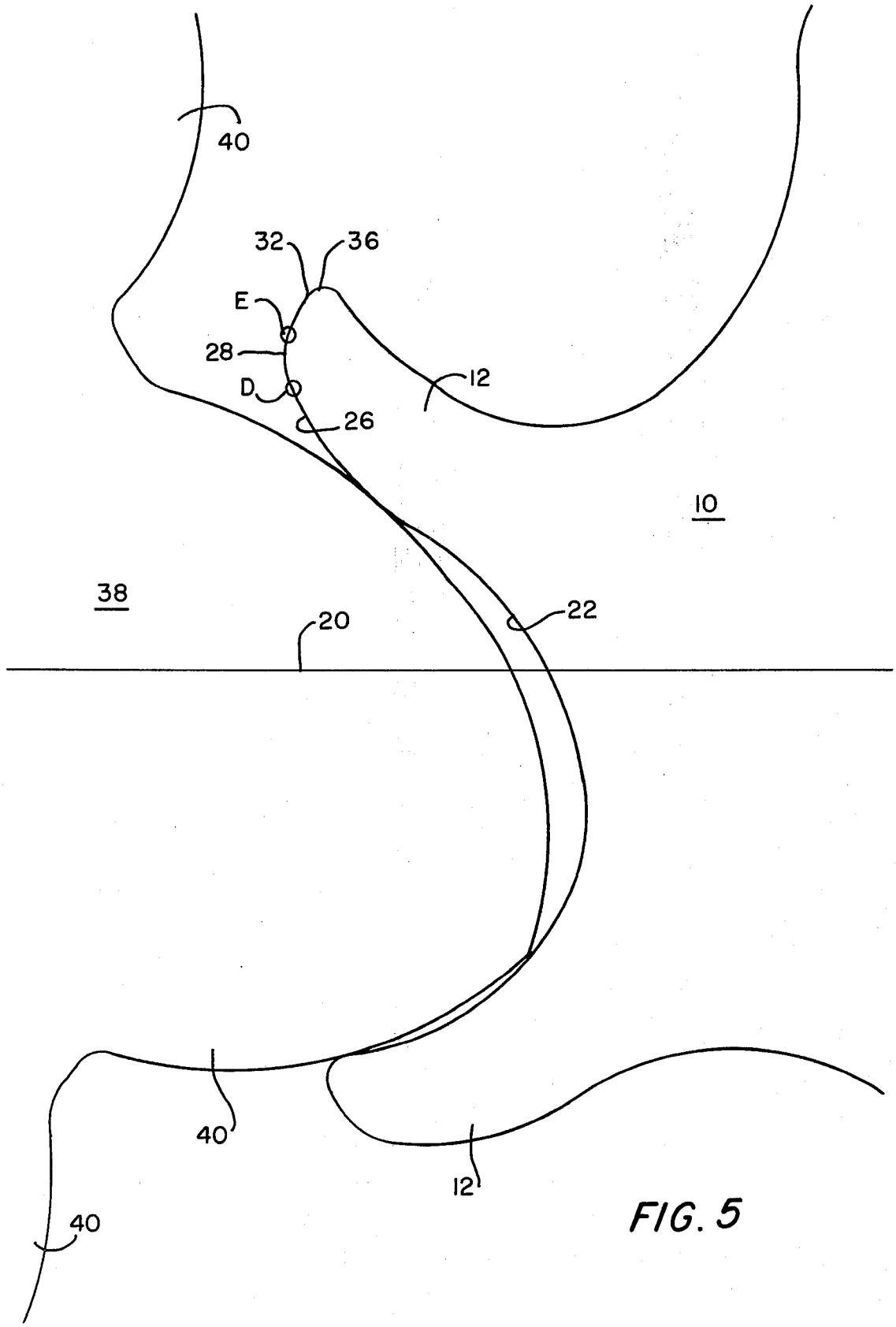
FIG. 5 is a greatly enlarged line illustration, depicting a lobe of the male rotor in coacting engagement with a recess in the female rotor, the same being provided to illustrate, with greater clarity, the elliptical portion of the leading flank of the female rotor groove.

According to the invention, the profile of the male rotor 38 is defined as follows. Section H-I of the male rotor 38 is a circular arc 48 with its center on the male rotor pitch circle 44. The circular arc 48 is identical to the circular arc 22 (B-C) on the female rotor 10. Section I-J is a generated section 50, the same being generated by the involute section 26 (D-C) of the female rotor 10. Section J-K is a generated section 52; it is generated by the elliptical section 28 (D-E) of the female rotor 10. Section K-$K_1$ is a circular arc 54. Section G-H is an epicycloid 56 generated by point A on the female rotor 10. Section G-$K_1$ is a circular arc 58 with its center on the pitch circle 44. As shown in FIG. 3, the rotors 10 and 38 are in interengaging mesh, and the involute section 26 of the female rotor 10 defines a substantially sealing interface with the generated section 50 (I-J) of the male rotor 38. The pressure angle defined therebetween is approximately forty degrees of arc. When the elliptical section 28 (D-E) of the female rotor 10 is closed upon the generated section 52 (J-K) of the male rotor (as shown in phantom, in FIG. 3), the pressure angle therebetween is substantially unchanged.

The location, i.e., the commencement, extents, and terminations, of the involute and elliptical section 26 and 28 are critical to the definition of the aforesaid pressure angles. By way of full disclosure, I set forth the starting point for the involute section 26. The female rotor 10 has an overall diameter defined by circle 30, and the grooves 14 have radially innermost points which define a minimum groove diameter 60. The involute section 26 extends outwardly, along the leading flank, from the starting point C, and point C is located at a diameter which is substantially midway between the overall diameter 30 and the minimum groove diameter 60.

The involute section 26 terminates at the pitch circle (at D) and smoothly blends, contiguously, with the elliptic section 28. The latter section also blends smoothly and contiguously with the outermost circular section 32.

In this 5/6 rotors configuration (i.e., five-lobe male rotor, six-rib female rotor) there is a further significant geometry which is a function of a minimum permissable rib width, the lengths of the elliptical section 28 and involute section 26, and the interface of the generated section 34 and the circular section 22. The latter interface occurs at point B, and the leading termination of the elliptical section 28 occurs at point E (on the outermost diameter 30). Now, a straight line 62 drawn between the interface point B and the aforesaid termination E must substantially traverse the starting point C of the involute section 24.

Besides the improved pressure angles (priorly noted) the rotor profiles define sealing points 64, 66 and 68 (FIG. 3) which cooperatively define a pocket 70 of compressed gas. Sealing point 64 is substantially a surface seal of considerable efficiency. It obtains between the involute section 26 of the female rotor 10 and the generated section 50 of the male rotor. Sealing points 66 and 68 are substantially point-contact seals and, therefore, of limited efficiency. Sealing point 66 is defined by the interface of point H on the male rotor 38 with the generated surface 34 on the female rotor 10; sealing point 68 is defined by the interface of point A on the female rotor 10 with the generated surface 56 on the male rotor. Now, it so happens that the rotor profiles cooperate to define the pocket 70 of such a configuration and effect as to apply a positive torque to the female rotor 10, and to enhance the less-efficient sealing points 66 and 68. This is explained in the ensuing text.

As shown in FIG. 3, the rotors effect revolution according to the arrows shown on each, in which the female rotor 10 moves in a clockwise fashion, and the coacting male rotor 38 turns in a counterclockwise direction. The pocket 70 is defined as an offset crescent to apply most of the gas pressure along a substantial length of the leading flank of the female rotor rib thereat, urging it in the clockwise or positive torque direction. Coincidentally, the pocket gas pressure applies a like pressure on the leading flank of the male rotor lobe thereat. As a result, the less secure seals of points 66 and 68 are finitely moved or biased into closer engagement whereby their critical sealing is enhanced.

Figure 4:
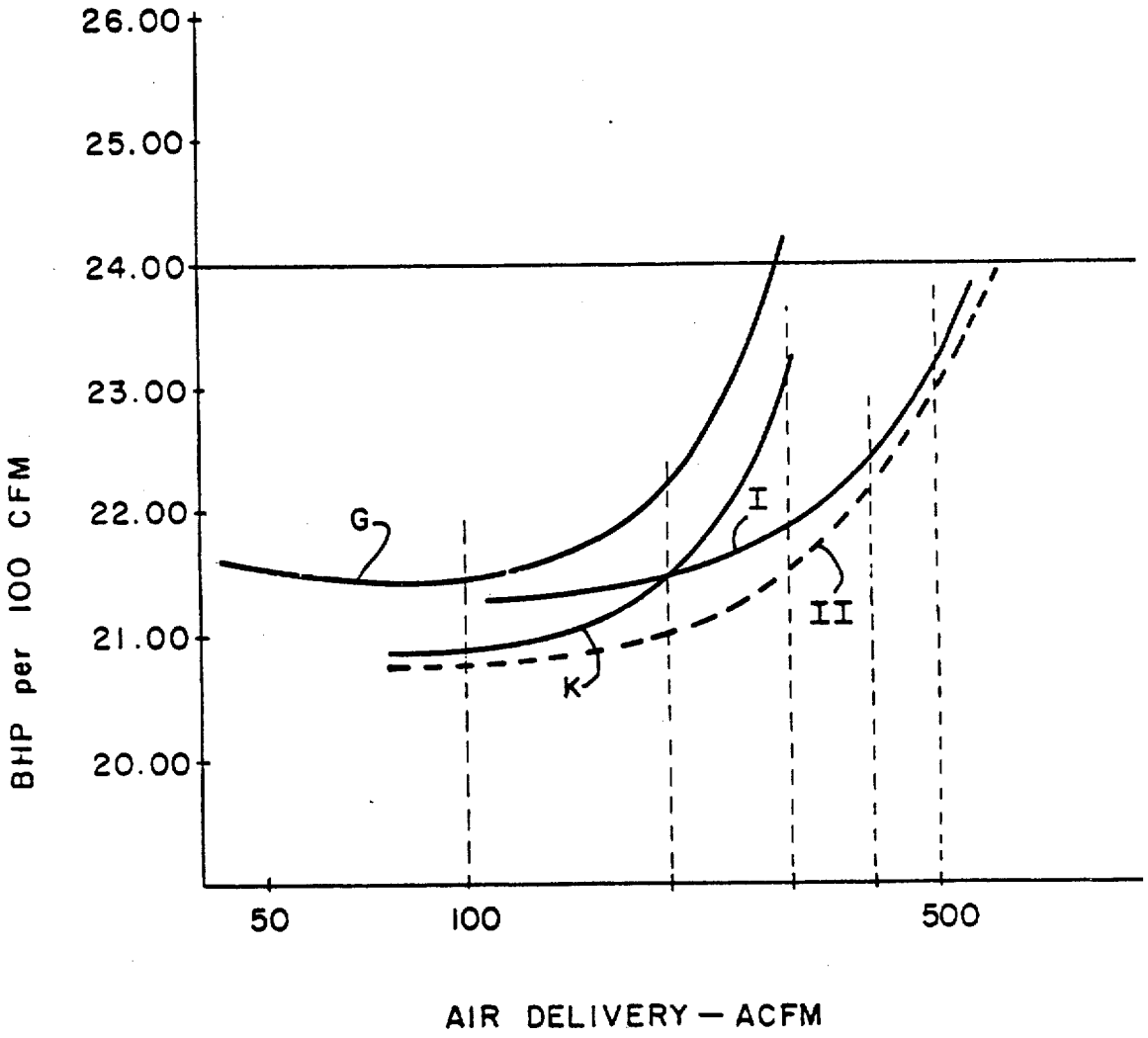
FIG. 4 is a plot of screw compressor performance curves.

This is, of course, a very crowded art, and improvements now come in small increments. Also the subtlties of profile refinements, pressure angles, and geometries may seem, at first, of little innovative significance. Yet, such refinements, if they do offer commendable improvements in machine performance and energy savings, are laudable, and advance the state of the art. The novel profiles set forth herein are such commendable improvements. FIG. 4 sets forth performance curves of relatively comparable screw compressors, compressors presently in the marketplace, denoted by the indices, "G" and "K". The curve "I" was derived from a first generation-prototype screw compressor generally defined according to the invention, and curve "II" was derived from a later, second generation-prototype screw compressor more definitively or painstakingly defined according to the invention. It has to be appreciated that the lower BHP and the relative flatness of the curve, of the curve "II" compressor, bespeak a significant advance in the art. It does proceed from the teachings herein of the new profile refinements, improved pressure angles, and specific profile geometries.

In addition to those already noted, the female rotor 10, especially, has further specific geometries which produce its efficiency. For instance, a circular arc 72 drawn from a center at the leading point B of the generated surface 34, which bisects the trailing point A (of the generated surface 34) comprises a radius which is substantially exactly twice the radius of a circular arc 74 drawn from a center at the starting point C of the involute section 26 which bisects the starting point D of the elliptic section 28. The elliptical section 28 encompasses a radial arc 76 which is not less than twice the radial arc 78 encompasses by the circular arc 36. The width of the profile of the rib(s) 12 at the radially outermost surface ($E$-$E_1$) is less than one-third the width across the profile at the location of the starting point C of the involute section 26.

These geometries, relative dimensions, and relationships have been carefully derived and defined to yield the improved-performance profiles of the novel rotors 10 and 38, and comprise teachings of my invention.

While I have described my invention in connection with specific embodiments thereof, it is to be clearly understood that this is done only by way of example, and not as a limitation to the scope of my invention as set forth in the objects thereof and in the appended claims.

I claim:

1. A rotor, having helical lands and intervening grooves rotatable about an axis for coacting engagement within a machine housing, with a cooperating, meshing rotor, in order that fluid admitted into such housing will be received in said grooves and, due to coacting mesh and rotation of said rotors, will have the pressure thereof altered, wherein:

each of said grooves has a leading flank and a trailing flank, relative to a given rotary direction of said rotor; and said leading and trailing flanks of said grooves of said rotor are generally concave;

said leading flank is made up of a circular arc at its root, followed by an involute intermediate portion, followed by an elliptical portion which is contiguous with an outermost tip of said rotor.

2. A rotor, according to claim 1, wherein:

a portion of said trailing flank which is contiguous with said leading flank describes a circular arc.

3. A rotor according to claim 1, wherein:

said involute portion is contiguous with said circular arc and said elliptical portion.

4. A rotor, according to claim 1, wherein:

said elliptical portion and said involute portion are contiguous.

5. A rotor, according to claim 1, wherein:

said elliptical portion merges with a land adjacent thereto;

said adjacent land further merges with a trailing flank of another most-adjacent groove through another circular arc; and said elliptical portion encompasses a radial arc having an extent which is not less than twice that encompassed by said another circular arc.

6. A rotor, according to claim 1, wherein:

said elliptical portion encompasses an arc which is not less than twice the radial arc encompassed by said circular arc.

7. A rotor, according to claim 1, wherein:

said rotor has a pitch circle centered on said axis; and said elliptical portion lies outside of said pitch circle.

8. A rotor, according to claim 7, wherein:

said involute portion lies inside of said pitch circle.

9. A rotor, according to claim 1, wherein:

said circular arc, involute portion, and elliptical portion comprise three unequal lengths or portions of said leading flank, and said circular arc, comprises a major portion of said leading flank.

10. A rotor, according to claim 4, wherein:

said elliptical portion comprises a minor portion of said leading flank.

11. A rotor, according to claim 4, wherein:

said involute portion comprises a median portion of said leading flank.

12. A rotor, according to claim 1, wherein:

said rotor has a given overall diameter;

each of said grooves has a radially innermost point which lies at a common, given radius from said axis, defining for said rotor a minimum groove diameter; and said involute portion extends outwardly, along said leading flank, from a starting point subsisting substantially midway between said overall diameter and said minimum groove diameter.

13. A rotor, according to claim 12, wherein:

said leading flank merges with a land adjacent thereto, defining thereat a flank termination;

said circular arc extends into said trailing flank to a point defining an arc termination; and a straight line drawn from said flank termination to said arc termination passes through said involute portion starting point.

14. A rotor, according to claim 12, wherein:

said trailing flank comprises a generated section having leading and trailing points;

said elliptical portion has leading and trailing points; and a circular arc drawn from a center at said leading point of said generated section, which bisects said trailing point of said generated section comprises a radius which is substantially exactly twice the radius of a circular arc drawn from a center at said starting point of said involute portion which bisects said trailing point of said elliptical portion.

15. A rotor, according to claim 12, wherein:

one of said leading flanks, and a trailing flank of a groove forward thereof, relative to said given rotary direction, define a rib therebetween; and said rib has a width at the radially outermost surface thereof which is less than one-third the width thereof and thereacross at the location of said starting point of said involute section.

* * * * *

UNITED STATES PATENT AND TRADEMARK OFFICE

CERTIFICATE OF CORRECTION

PATENT NO. : 4,412,796

DATED : November 1, 1983

INVENTOR(S) : James L. Bowman

It is certified that error appears in the above—identified patent and that said Letters Patent is hereby corrected as shown below:

The sheet of drawing consisting of Figure 4 should be added as per attached sheet.

Signed and Sealed this

*First* Day of *May 1984*

[SEAL]

*Attest:*

GERALD J. MOSSINGHOFF

*Attesting Officer*

*Commissioner of Patents and Trademarks*